US008251733B2

(12) United States Patent
Wu

(10) Patent No.: US 8,251,733 B2
(45) Date of Patent: Aug. 28, 2012

(54) CABLE CONNECTOR ASSEMBLY

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/015,295

(22) Filed: Jan. 27, 2011

(65) Prior Publication Data

US 2011/0195586 A1 Aug. 11, 2011

(30) Foreign Application Priority Data

Feb. 8, 2010 (CN) ..... 1010 2 0302543

(51) Int. Cl.
*H01R 13/627* (2006.01)

(52) U.S. Cl. ..... 439/352; 439/160; 439/76.1

(58) Field of Classification Search ..... 439/352, 439/76.1, 358, 160
See application file for complete search history.

(56) References Cited

U.S. PATENT DOCUMENTS

| | | | | |
|---|---|---|---|---|
| 7,114,980 | B1 * | 10/2006 | Wu | 439/352 |
| 7,238,040 | B1 | 7/2007 | Wu | |
| 7,651,341 | B2 | 1/2010 | Wu | |
| 7,666,023 | B2 * | 2/2010 | Wu | 439/352 |
| 7,690,939 | B2 * | 4/2010 | Wu | 439/352 |
| 7,841,887 | B2 * | 11/2010 | Zhang et al. | 439/352 |
| 7,857,650 | B1 * | 12/2010 | Wu | 439/352 |

* cited by examiner

*Primary Examiner* — Hien Vu
(74) *Attorney, Agent, or Firm* — Wei Te Chung; Andrew C. Cheng; Ming Chieh Chang

(57) ABSTRACT

A cable connector assembly includes a housing including a first base and a second base coupled with the first base, at least a circuit board received in the housing and defining two rows of conductive pads located at two opposite sides thereof, at least a cable including a plurality of conductors electrically connecting with one row of the conductive pads of the circuit board, a pulling mechanism movably fixed to an outside face of the housing and separating the cable connector assembly from a complementary cable connector, and a metal shell partially shielding the pulling mechanism. The second base defines through grooves. The first base includes locking pieces inserted into the through grooves with free ends extending out of the through grooves from the outside face and bended to abut against the outside face of the housing.

7 Claims, 9 Drawing Sheets

CABLE CONNECTOR ASSEMBLY

BACKGROUND OF THE INVENTION

1. Field of the Invention

The present invention relates to a cable connector assembly, and more particularly to a cable connector assembly used for high-speed signal transmission.

2. Description of the Related Art

U.S. Pat. No. 7,238,040 issued on Jul. 3, 2007 discloses a cable connector assembly includes a housing, a circuit board received in the housing, a cable electrically connecting with the circuit board and a metal shell covering on the housing. The housing includes a first base, a second base assemble to the first base and a receiving room between the first base and the second base. The first base, the second base and the metal shell is assembled together just by a plurality of screws and bolts. So the bolts must be long enough to run through the first base, the second base and the metal shell. In order to improve stabilization of the cable connector assembly, a better method of securing the housing and the metal shell is needed.

In view of the above, a new cable connector assembly that overcomes the above-mentioned disadvantages is desired.

SUMMARY OF THE INVENTION

Accordingly, an object of the present invention is to provide a cable connector assembly having a locking structure to secure a pair of metal housings together.

To fulfill the above-mentioned object, a cable connector assembly comprises a housing including a first base and a second base coupled with the first base, at least a circuit board received in the housing and defining two rows of conductive pads located at two opposite sides thereof, at least a cable including a plurality of conductors electrically connecting with one row of the conductive pads of the circuit board, a pulling mechanism movably fixed to an outside face of the housing and separating the cable connector assembly from a complementary cable connector, and a metal shell partially shielding the pulling mechanism. The second base defines through grooves. The first base includes locking pieces inserted into the through grooves with free ends extending out of the through grooves and bended to abut against the outside face of the housing.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Figure 1:
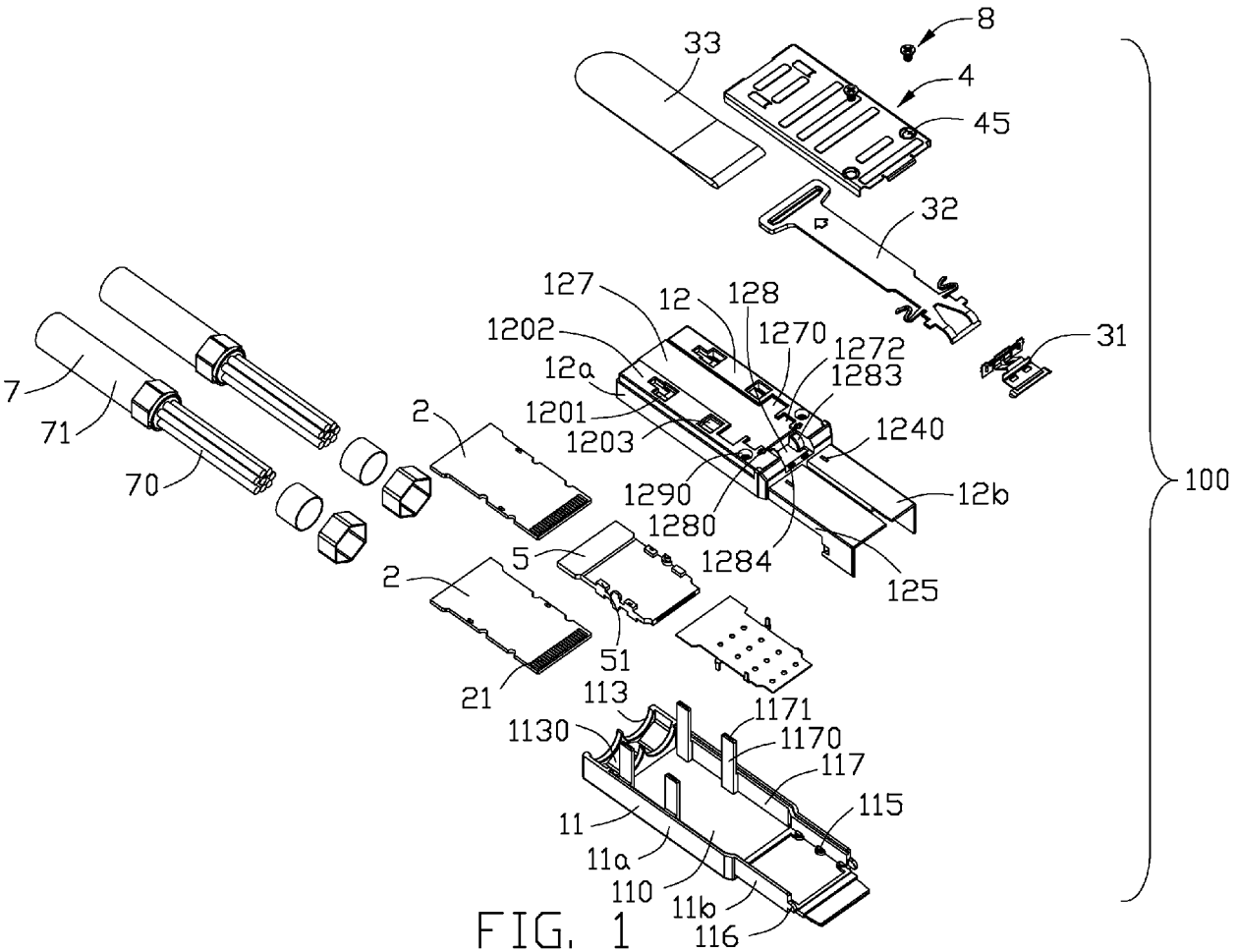
FIG. 1 is a top exploded view of a cable connector assembly of the present invention.

Reference will now be made to the drawings to describe the present invention in detail.

Referring to FIGS. 1-7, a cable connector assembly 100 includes a metal housing 1, a pair of circuit boards 2 received in the metal housing 1, a pair of cables 7 electrically connecting with the circuit boards 2, a pulling mechanism 3 assembled to the metal housing 1 and a metal shell 4 partially shielding the pulling mechanism 3.

Figure 2:
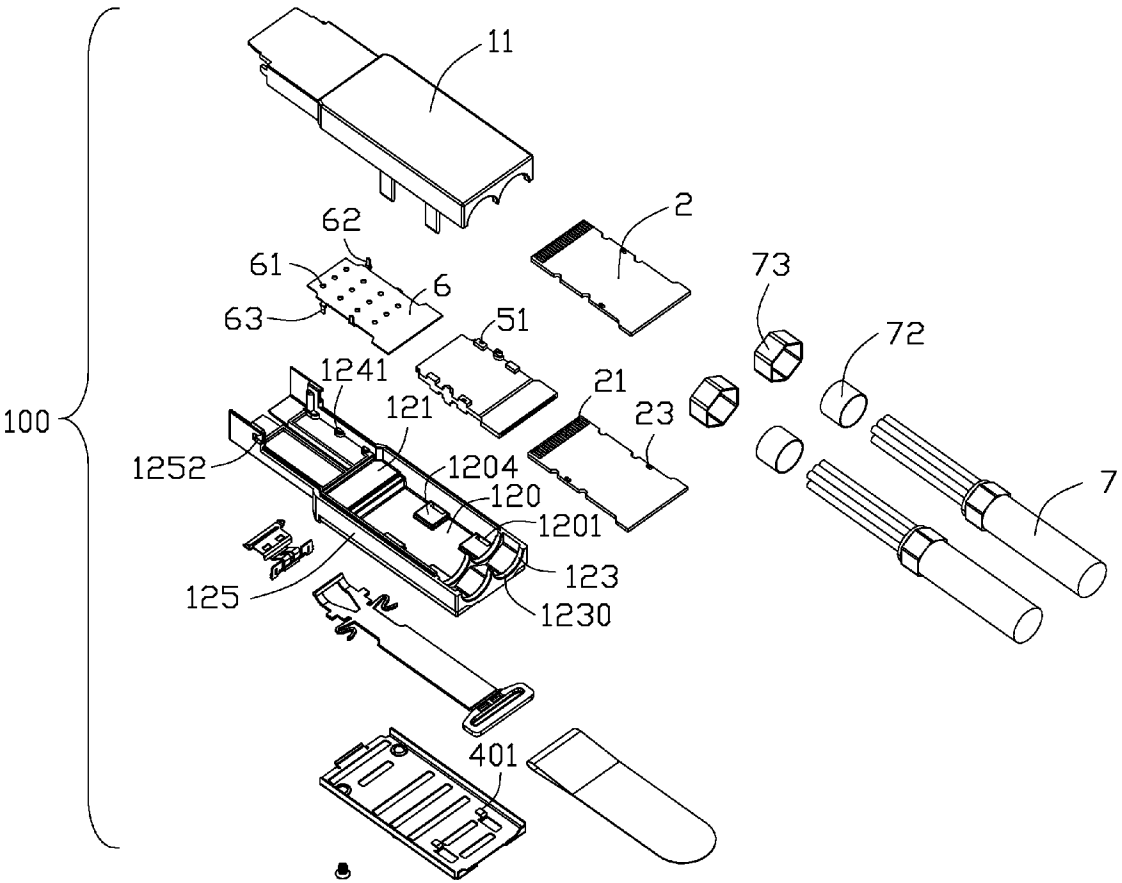
FIG. 2 is a bottom exploded view of the cable connector assembly of FIG. 1.
Figure 6:
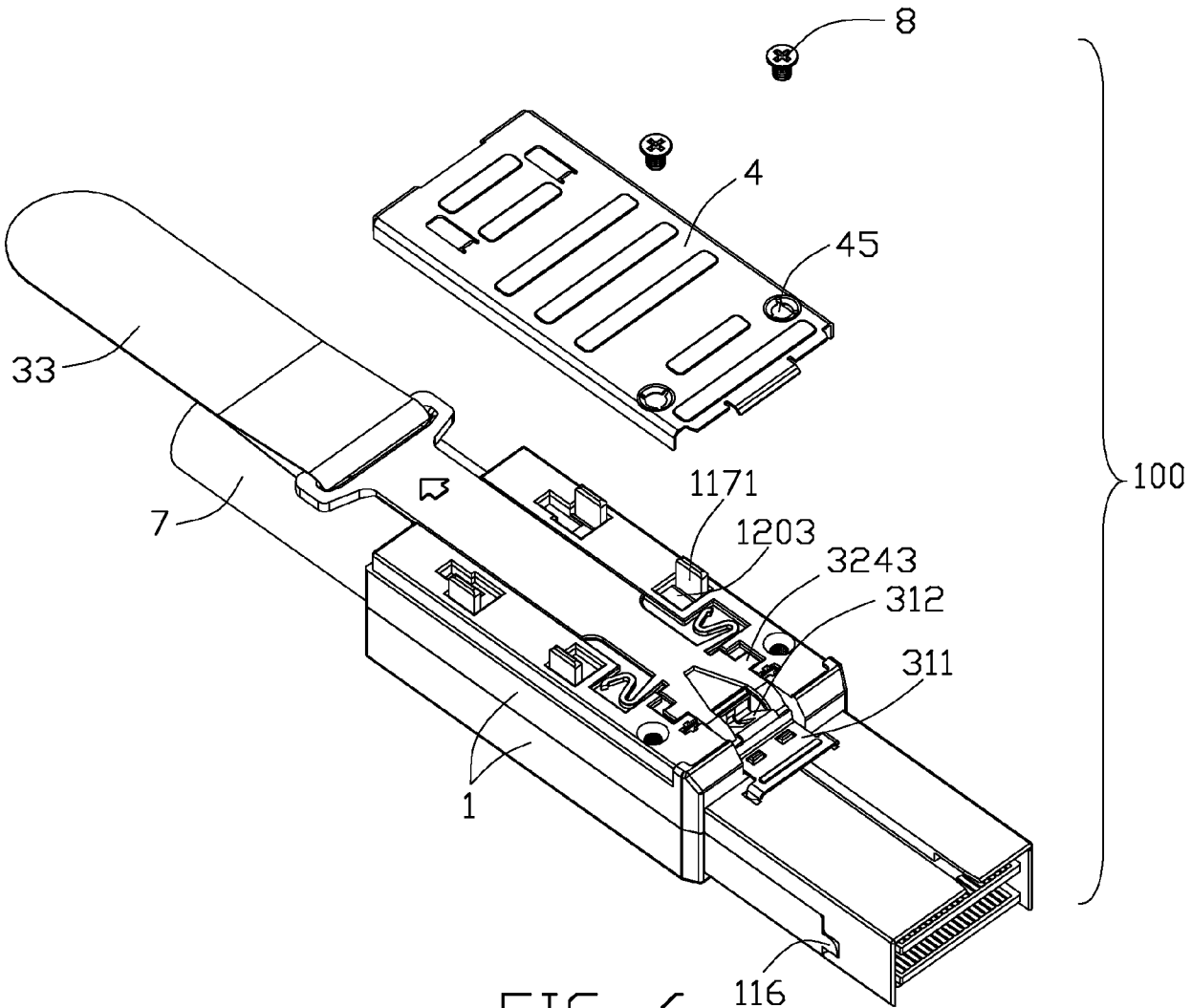
FIG. 6 is a top part exploded perspective view of the cable connector assembly of FIG. 1 wherein the metal shell is not assembled to the cable connector assembly.
Figure 7:
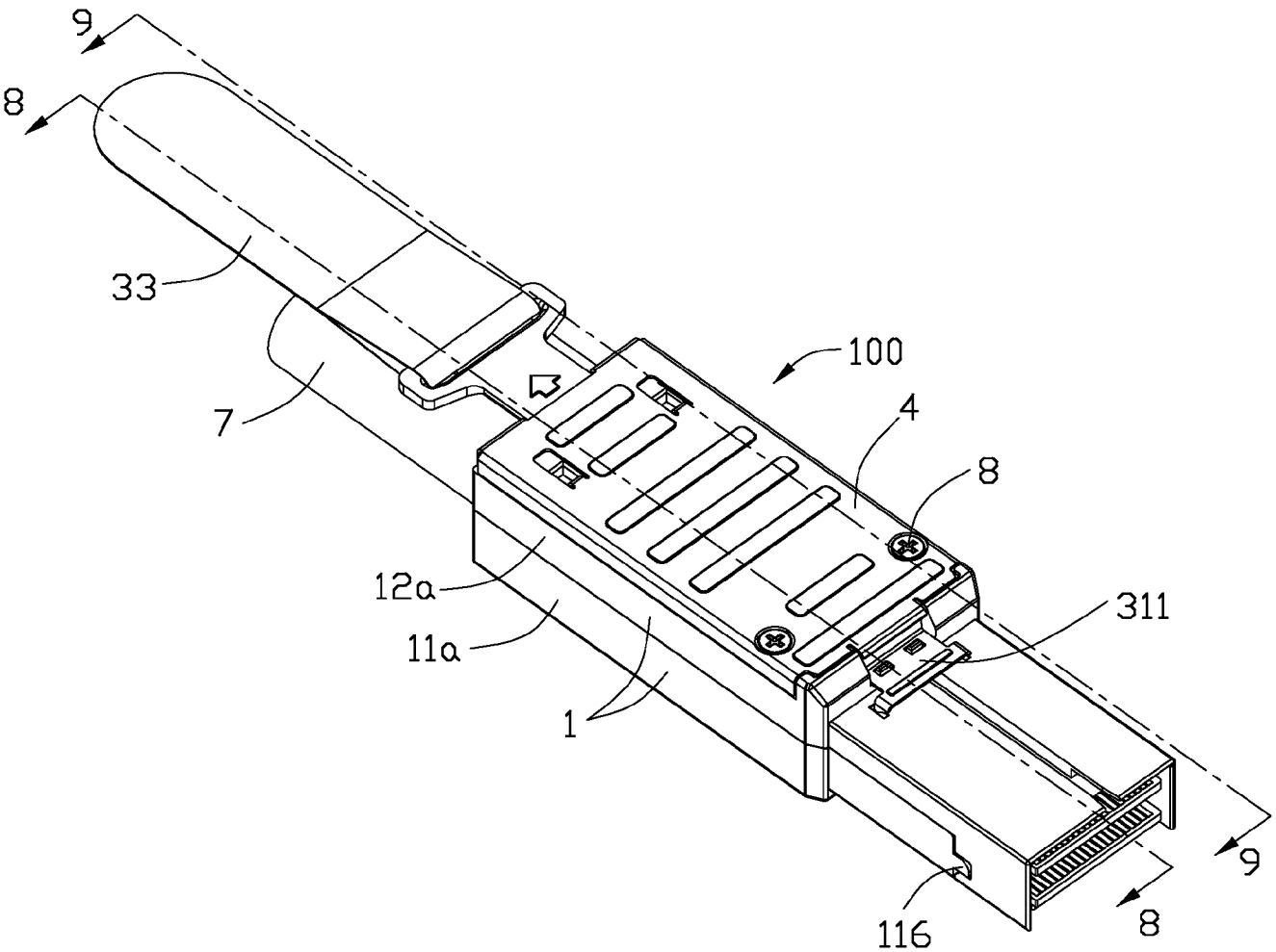
FIG. 7 is a perspective view of the cable connector assembly of FIG. 1.
Figure 8:
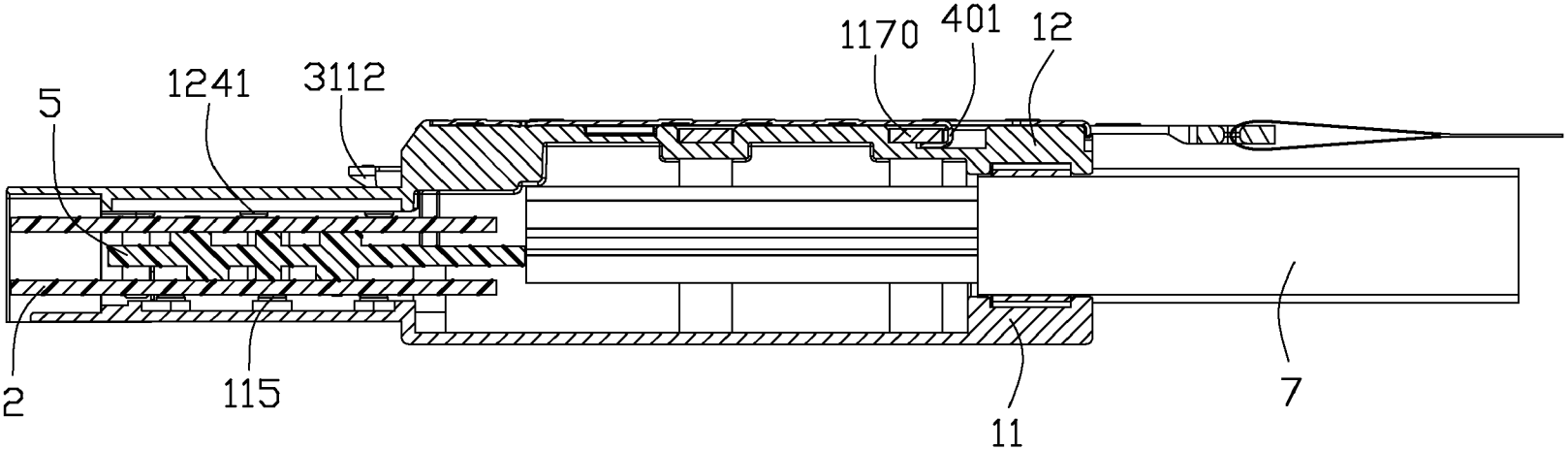
FIG. 8 is a cross sectional view of the cable connector assembly of FIG. 7 taken along line 8-8.

Referring to FIGS. 1, 2 and 6, the metal housing 1 includes a first base 11 and a second base 12 coupled with the first base 11. The first base 11 includes a first main portion 11*a* and a first mating portion 11*b* extending forwardly from the first main portion 11*a*. The second base 12 includes a second main portion 12*a* corresponding to the first main portion 11*a* and a second mating portion 12*b* extending forwardly from the second main portion 12*a*. The first base 11 defines a first bottom wall 110, a pair of first side walls 117 extending upwardly from two sides of the first bottom wall 110 and a first rear wall 113 extending upwardly from a rear side of the first bottom wall 110 and bridging two first side walls 117. The second base 12 defines a second top wall 120, a pair of second side walls 125 extending downwardly from two sides of the second top wall 120 and a second rear wall 123 extending downwardly from a rear side of the second top wall 120 and bridging the two second side walls 125. Each first side wall 110 defines a protrusion 116 extending from a front end thereof. Each second side wall 125 is configured with L-shaped and defines a position groove 1252 located at a wider section thereof to receive the protrusion 116. The first rear wall 113 forms a pair of first semi-columnar grooves 1130 and the second rear wall 123 forms a pair of second semi-columnar grooves 1230 corresponding to the first semi-columnar grooves 1130. Referring to FIG. 8, the first semi-columnar grooves 1130 and the second semi-columnar grooves 1230 are configured with a pair of columnar receiving cavities to receive the cables 7.

Figure 4:
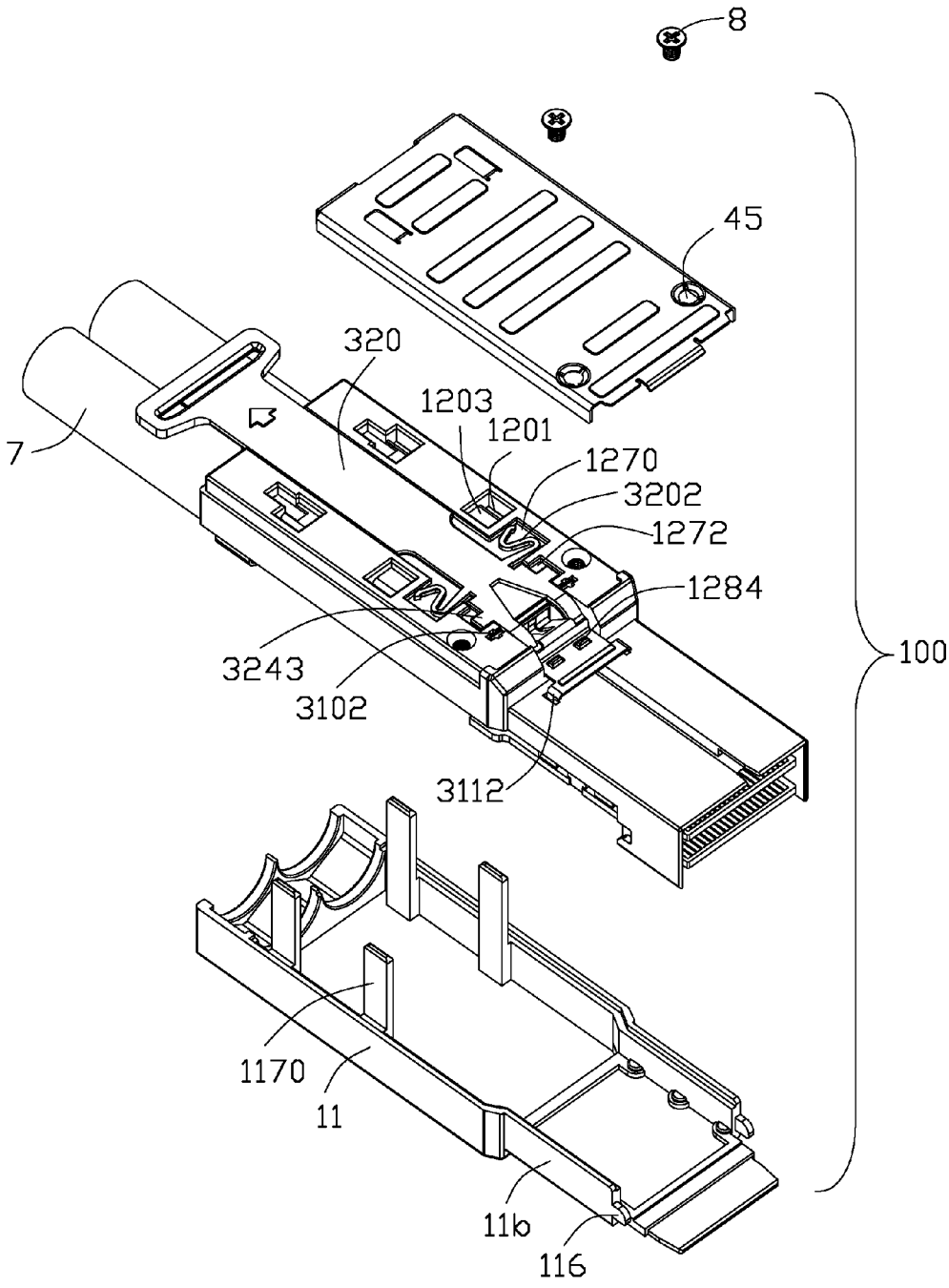
FIG. 4 is a top part exploded perspective view of the cable connector assembly of FIG. 1 wherein a first base and a metal shell are not assembled to the cable connector assembly.

The first bottom wall 110 of the first main portion 11*a* defines two pairs of locking pieces 1170 in two rows respectively adjacent to the corresponding first side walls 117. The second top wall 120 defines two pairs of reinforce cushions 1204 and each reinforce cushion forms a through groove 1201. Referring to FIGS. 4 and 6, the locking pieces 1170 are inserted into the through grooves 1201. An outside face 1202 of the second top wall 120 further defines retaining grooves 1203 communicating with the through grooves 1201. Top Free ends 1171 of the locking pieces 1170 extend out of the through grooves 1201 from the outside face 1202 and are bended to be received in the retaining grooves 1203 to secure the first base 11 and the second base 12 before the metal shell 4 is assembled to the metal housing 1.

Figure 9:
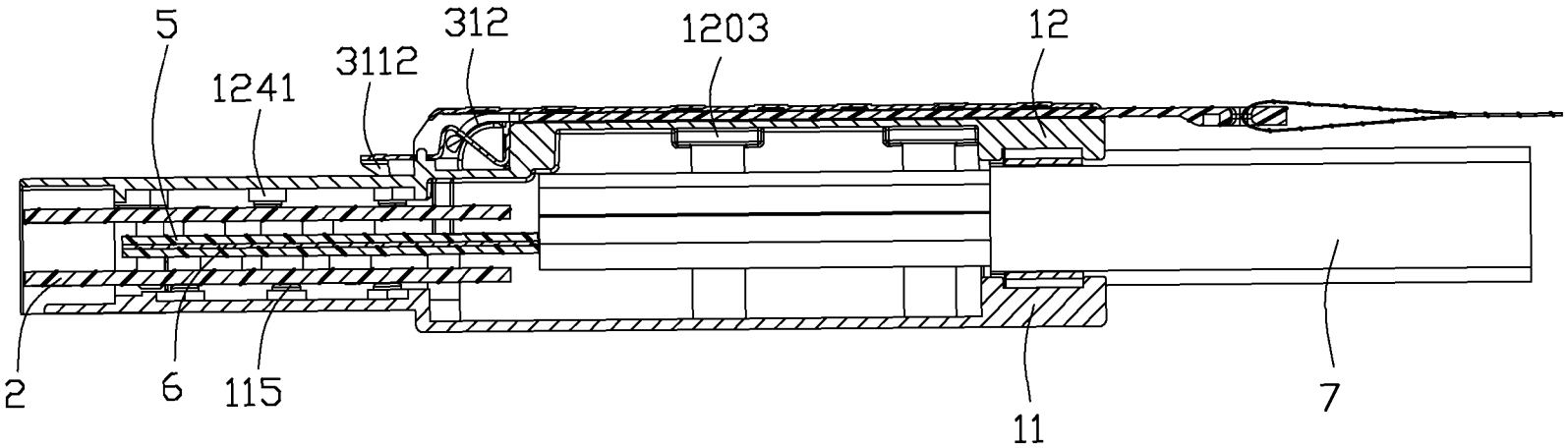
FIG. 9 is a cross sectional view of the cable connector assembly of FIG. 7 taken along line 9-9.

Referring to FIGS. 2, 8 and 9, the first bottom wall 110 of the first mating portion 11*b* defines a plurality of first ribs 115 arranged in two rows adjacent to the corresponding first side walls 117. The second top wall 120 of the second mating portion 12*b* defines a plurality of second ribs 1241 corresponding to the first ribs 115. The circuit boards 2 are put between the first ribs 115 and the second ribs 1241. The cable connector assembly includes a partition wall 5 insert-molded with a metal board 6 therein, which is located between the two circuit boards 2. The partition wall 5 defines a plurality of tubers 51 at two side edges. The metal board 6 defines a plurality of through holes 61, a pair of first position legs 62 extending downwardly out of the tuber 51 of the partition wall 5 and a pair of second position legs 63 extending upwardly out of the partition wall 5. The two circuit boards 2 respectively define a pair of position holes 23. The position legs 62, 63 are inserted into the corresponding position holes 23 to secure the partition wall 5 and the circuit boards 2.

Referring to FIG. 1, the outside face 1202 of the second top wall 120 further defines a cutout 128 located at a front side of the second main portion 12*a* and a depressed area 127. The depressed area 127 defines a pair of first sunken portions 1270 and a pair of second sunken portions 1272 expanding outward from two sides thereof. The cutout 128 forms a pair of arc-shaped blocks 1283 at two sides thereof and a pair of position blocks 1284 at a front side thereof. The second top wall 12 further defines a pair of narrow grooves 1280 extending outward from two sides of the cutout 128 and communicating with the cutout 128. The second mating portion 12*b* defines a pair of latching grooves 1240.

Figure 3:
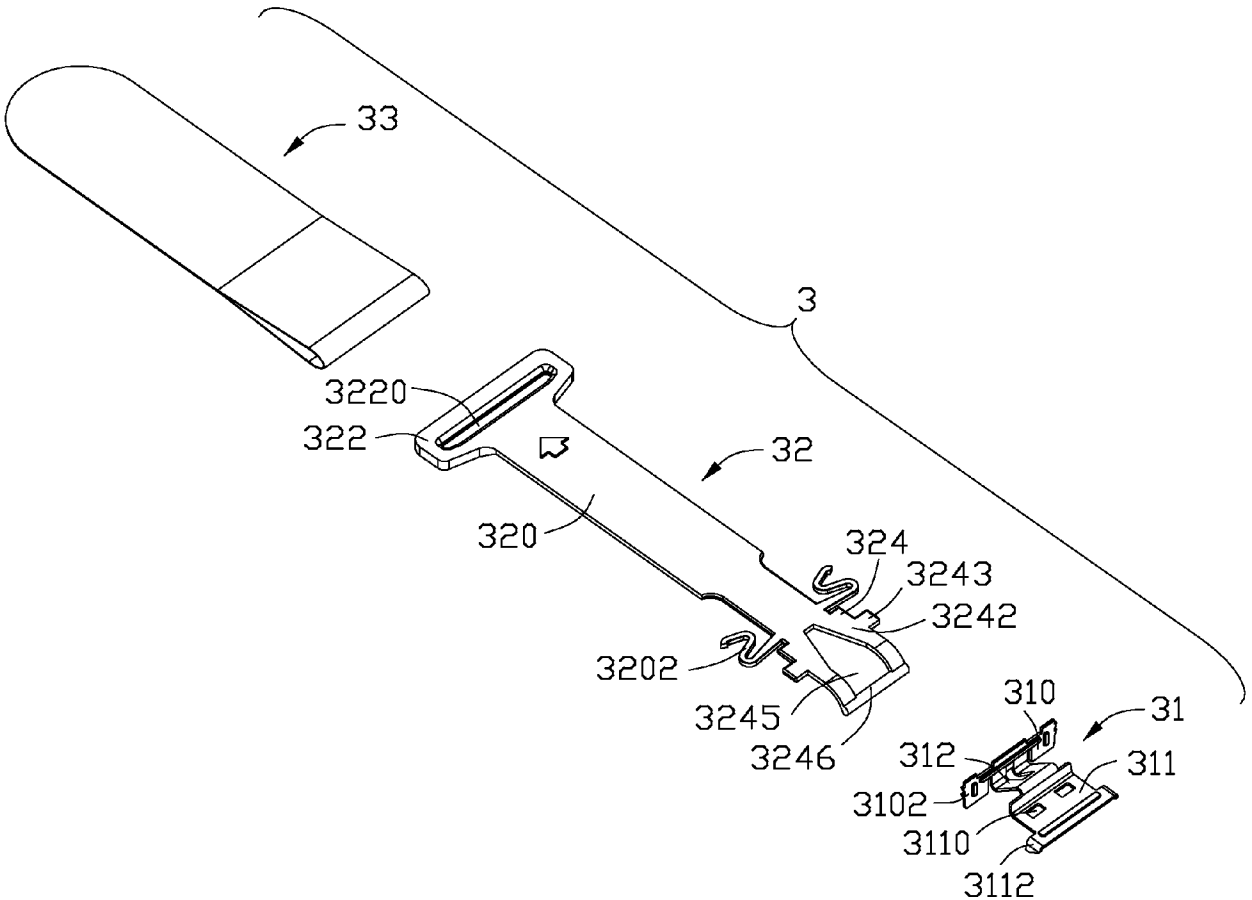
FIG. 3 is an exploded view of a pulling mechanism of FIG. 1.

Referring to FIGS. 3 and 4, the pulling mechanism 3 includes a retaining member 31, a pulling member 32 and a pulling tape 33. The retaining member 31 is made of metal material and includes an engaging portion 310, a flat latching portion 311 and an inclined connecting portion 312 connecting the engaging portion 310 with the latching portion 311 to provide spring force to the pulling mechanism 3. The retaining member 31 defines a pair of flange portions 3102 receiving in the narrow grooves 1280. The latching portion 311 defines fixing grooves 3110 receiving the position blocks 1284 and hook portions 3112 inserted into the latching grooves 1240 to grasp the metal housing 1. The pulling member 32 is made of insulative material and includes a front cooperating portion 324, an elongated intermediate portion 320 extending rearward from the cooperating portion 324 and an operating portion 322 formed at a rear end of the intermediate portion 320. The cooperating portion 324 defines a fixing hole 3245 surrounding by a pair of side strip 3242 and a front strip 3246 and a pair of flange portions 3243 extending outside from side strips 3242. The side strips 3242 are configured with arc shaped. The engaging portion 310 runs across the fixing groove 3245 in an upward-to-downward direction and the inclined connecting portion 312 abuts against the front strip 3242 of the cooperating portion 324 to assemble the pulling member 32 to the retaining member 31. The intermediate portion 320 defines a pair of elastic arms 3202 of S-shaped at two opposite sides thereof adjacent to the cooperating portion 324. The operating portion 322 defines a slot 3220 at a rear end thereof. The pull tape 33 is a piece of belt running across the slot 3220 and defines two opposite ends sticked to each other to fix the pull tape 33 to the pulling member 32. The engaging portion 310 abuts against a vertical face of the cutout 128. The flange portions 3102 are received in the narrow grooves 1280. The side strips 3242 of fixing hole 3245 abut against the arc-shaped blocks 1283. The flange portions 3243 are movably received in the second sunken portions 1272 and the elastic arms 3202 are received in the first sunken portions 1270. The cable connector assembly 100 can apart from a complementary cable connector by the pulling mechanism 3.

Figure 5:
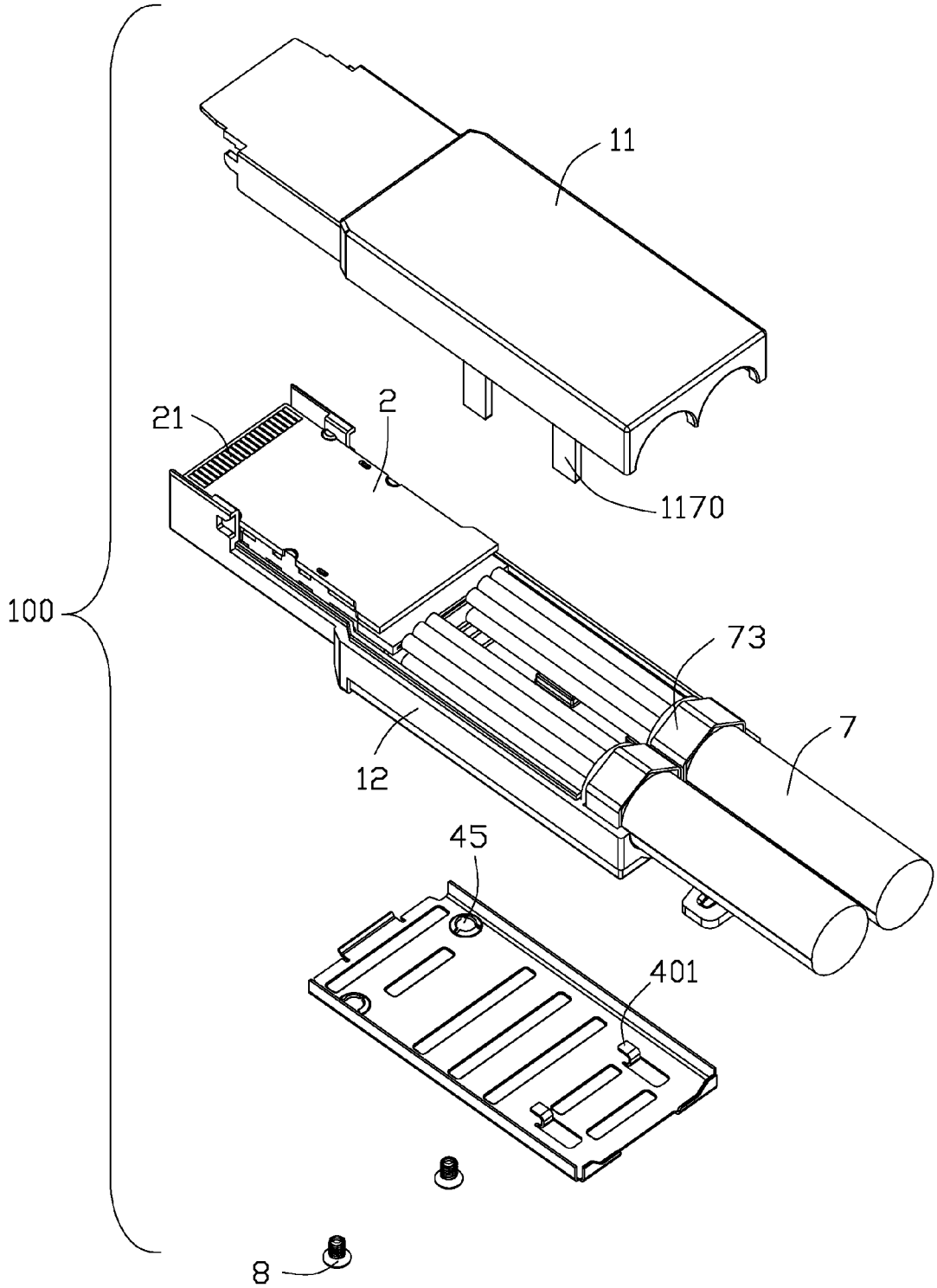
FIG. 5 is a bottom part exploded perspective view of the cable connector assembly of FIG. 4.

Referring to FIGS. 1, 2 and 5, each cable 7 includes a plurality of conductors 70, an insulative layer 71 enveloping a rear end of the conductors 70, an inner holding ring 72 enveloping a end of the insulative layer 71 and an outer holding ring 73 enveloping the inner holding ring 72. Each circuit board 2 defines two rows of conductive pads 21 in a front-to-rear direction. The conductors 70 are soldered to a rear row of conductive pads (not shown). The second bottom wall 120 of the second main portion 12*b* defines a step 121 at a front side thereof adjacent to the second mating portion 12*a* and front ends of the cables 7 resist on the step 121. The cables 7 are received in the columnar receiving cavities and located between the two rows locking pieces 1170.

The metal shell 4 covers on the outside face 1202 of the second top wall 120 and defines a pair of first screws 45 adjacent to a front side thereof. The second top wall 120 defines a pair of second screws 1290 corresponding to the first screws 45. A pair of bolts 8 is inserted in the first screws 45 and the second screws 1290 to secure the metal shell 4 and the metal housing 1. The metal shell 4 is torn apart a pair of U-shaped hooks 401 adjacent to a rear side there. Two retaining grooves 1203 far from the second screws 1290 defines a large enough to receive the U-shaped hooks 401 and the free ends 1171 of the locking pieces 1170. Referring to FIG. 8, after the metal shell 4 covers on the metal housing 1, the U-shaped hooks 401 are moved forward and envelop the locking pieces 1170.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a housing comprising a first base and a second base coupled with the first base, at least a circuit board received in the housing and defining two rows of conductive pads located at two opposite sides thereof;

at least a cable comprising a plurality of conductors electrically connecting with one row of the conductive pads of the circuit board;

a pulling mechanism movably fixed to an outside face of the housing and separating the cable connector assembly from a complementary cable connector;

a metal shell partially shielding the pulling mechanism;

wherein the second base defines through grooves, the first base comprises locking pieces inserted into the through grooves with free ends extending out of the through grooves from the outside face and bended to abut against the outside face of the housing by the metal shell;

wherein the cable connector assembly comprises two circuit boards and a partition wall made of insulative material between the two circuit boards, a metal board is insert-molded in the partition wall;

wherein the metal board defines a plurality of through holes and comprises a plurality of position legs extending out of the partition wall, the circuit boards define a plurality of position holes retaining the position legs; and wherein the pulling mechanism comprises a retaining member, a pulling member and a pulling tape, the pulling member defines a fixing hole surrounding by a pair of side strips and a front strip, the retaining member defines an engaging portion running across the fixing hole and retained in the second base and an inclined connecting portion abutting against the front strip.

2. The cable connector assembly as claimed in claim 1, wherein the outside face of the second base defines retaining grooves communicating with the through grooves, the free ends of the locking pieces received in the retaining grooves.

3. The cable connector assembly as claimed in claim 2, wherein the metal shell is torn apart a pair of U-shaped hooks, the retaining grooves are big enough to receive the free ends of the locking pieces and the U-shaped hooks, the U-shaped hooks envelop the free ends of the locking pieces.

4. The cable connector assembly as claimed in claim 3, wherein the metal shell defines a plurality of first screws, the second base defines a plurality of second screws corresponding to the first screws, a plurality of bolts are inserted in the first screws and the second screws.

5. The cable connector assembly as claimed in claim 4, wherein the second screws and the U-shaped hooks are respectively adjacent to two opposite sides of the metal shell.

6. The cable connector assembly as claimed in claim 1, wherein the outside face of the second base defines a cutout at a front side, a pair of arc-shaped blocks is formed in two sides of the cutout and the side strips of the fixing hole abut against the arc-shaped blocks.

7. An electrical connector comprising:

a housing including a pair of bases assembled to each other to commonly define a receiving space which communicates with an exterior in a front-to-back direction; a mating port defined in said receiving space;

a cable assembly extending into the receiving space and electrically connected to the mating port;

a latch mechanism assembled on an exterior face of one of said bases and said latch mechanism protectively covered by a metal shield in a vertical direction perpendicular to said front-to-back direction;

said one of the bases defining a plurality of holes extending through the exterior face, the other of the bases defining a plurality of deflectable arms extending into the receiving space and through the corresponding holes, respectively, and further bent onto the exterior face by said metal shield to secure the pair of bases together under condition that the distal end regions of said deflectable arms are protectively hidden under the shield;

wherein the cable connector assembly comprises two circuit boards and a partition wall made of insulative material between the two circuit boards, a metal board is insert-molded in the partition wall; and wherein the metal board defines a plurality of through holes and comprises a plurality of position legs extending out of the partition wall, the circuit boards define a plurality of position holes retaining the position legs.

* * * * *